US005772778A

United States Patent [19]

Bäck

[11] Patent Number: 5,772,778

[45] Date of Patent: Jun. 30, 1998

[54] METHOD AND MEANS FOR WASHING AND DISPENSING OF BALLS

[76] Inventor: Bengt Adolf Emanuel Bäck, Stenbarsgatan 7, S-745 42, Enköping, Sweden

[21] Appl. No.: 624,509

[22] PCT Filed: Oct. 5, 1993

[86] PCT No.: PCT/SE93/00806

§ 371 Date: Apr. 5, 1996

§ 102(e) Date: Apr. 5, 1996

[87] PCT Pub. No.: WO95/09678

PCT Pub. Date: Apr. 13, 1995

[51] Int. Cl.[6] ..... A63B 47/04

[52] U.S. Cl. ..... 134/6; 15/21.2; 134/25.4

[58] Field of Search ..... 134/6, 25.1, 25.4, 134/83, 133; 15/21.2

[56] References Cited

U.S. PATENT DOCUMENTS

| | | | |
|---|---|---|---|
| 2,540,687 | 2/1951 | Netterstrom | 15/21 |
| 2,931,058 | 4/1960 | Knudsen | 15/21 |
| 3,038,186 | 9/1962 | Davy | 15/21 |
| 3,066,335 | 12/1962 | Brown, Jr. | 15/21 |
| 3,244,319 | 4/1966 | Fessman | 221/203 |
| 3,248,008 | 4/1966 | Meierjohan | 221/205 |
| 3,733,633 | 5/1973 | Gustafson | 15/21 A |
| 3,784,996 | 1/1974 | Ambrose | 15/21 A |
| 3,946,847 | 3/1976 | Bock | 194/57 |
| 3,949,443 | 4/1976 | Edgar | 15/21 A |
| 4,054,197 | 10/1977 | Bock | 194/57 |
| 4,126,217 | 11/1978 | Bock | 194/93 |
| 4,181,996 | 1/1980 | Hollrock | 15/21 A |
| 4,773,114 | 9/1988 | Thrasher | 15/21 A |
| 5,077,854 | 1/1992 | Moons | 134/133 |

FOREIGN PATENT DOCUMENTS

| | | |
|---|---|---|
| 0328855 | 8/1989 | European Pat. Off. . |
| 455901 | 8/1988 | Sweden . |
| 88/02270 | 4/1988 | WIPO . |

*Primary Examiner*—Ivars Cintins
*Attorney, Agent, or Firm*—Birch, Stewart, Kolasch & Birch, LLP

[57] ABSTRACT

The invention relates to a method and an apparatus for cleaning and dispensing golf balls from a magazine. The balls are advanced and brushed clean by a brush roll which rotates in the direction of movement of the balls over tracks or paths defined by parallel devices having curved upper ends which surround the underside of the roll. The apparatus also includes a grid which delimits the lower part of the tracks in an upward direction and which extends from the roll to a ball dispensing arrangement. The formation of bridges or ball-clusters in the magazine is counteracted with the aid of an eccentrically mounted roll, and washing liquid is delivered from spray nozzles.

16 Claims, 3 Drawing Sheets

METHOD AND MEANS FOR WASHING AND DISPENSING OF BALLS

BACKGROUND OF THE INVENTION

1. Field of the Invention

The present invention relates to a method of cleaning and dispensing balls or other generally spherical objects from a magazine. The invention also relates to apparatus for carrying out the method.

2. Description of the Background Art

The invention is particularly intended for handling golf balls. Golf courses include separate so-called driving ranges on which golf strokes (swings) can be practiced. For safety reasons, it is not allowed to retrieve balls that have been struck, and the general practice is to purchase a bucket of training balls from a ball dispensing machine. The balls are then collected by means of a special ball collecting device and returned to the ball dispensing machine. Such ball dispensing machines are known from U.S. Pat. Nos. 4,054,197, 4,126,217 and 3,946,847, among others. The balls are dispensed from these machines through a chute or along an inclined floor to a pivotal part of the machine, such as a cradle or a dispensing wheel which includes a compartment which accommodates one or more rows of balls, and a dispensing chute which leads to a bucket. Apparatus of this kind, however, are liable to malfunction and be subjected to other disturbances due to dirt and grit on the balls, and also due to defective balls, such as half-balls, and balls from which parts have been knocked-off or balls whose dimensions have been enlarged as a result of cracks, splits or swelling. This will result in the balls lodging in the ball dispensing chute or will prevent balls from rolling to the dispensing part of the apparatus. This means that the golfer will not receive the number of balls that he has paid for.

The problem of grit, dirt, clay or mud on the balls can be overcome by using a separate ball washing device. Several such devices are known to the art and include different types of brush disks or brush cylinders. The balls are normally washed with a washing liquid delivered through spray nozzles, and/or by pressing the balls down into a liquid bath during the washing operation. The balls are then dispensed through a dispensing chute to a collecting vessel. Examples of such ball washers are described in U.S. Pat. Nos. 3,038,186 and 4,773,114, in which during a washing operation, the balls are conveyed forwards by a brush cylinder in a helical path along the cylinder. Such ball washers are not included, however, in automatic ball dispensers intended for selling practice balls for stroke-training purposes. Instead, it is necessary for the golf course personnel to transfer the balls to the ball dispenser, which is naturally cost demanding and is also liable to cause injury to the personnel concerned as a result of having to lift the balls to a high level in an unfavourable position.

The balls also tend to hang and form bridges (clusters) in both automatic ball dispensers and in ball washing machines, such as to prevent the balls from being advanced. U.S. Pat. No. 3,733,633 teaches a solution to this problem in the form of a ball washing machine which includes a roll or cylinder which extends transversely across and above the floor of the magazine. The roll includes means which counteract the passage of golf balls along a part of the roll periphery and press the balls back in a direction upwardly of the magazine floor, so that the golf balls will be arranged in a sequential row downstream of the roll. The roll has generally an ellipsoidal shape and is covered externally with bristles.

U.S. Pat. No. 3,244,319 attempts to solve the problem whereby not all of the balls are able to roll to the dispensing location under their own force, with the aid of an ejector wheel which is intended to force the balls out through a discharge tube. The ejector wheel has a vertical axle and is mounted in a circular recess in the bottom of the ball magazine, said ejector wheel forming the inner wall and the bottom of an annular passageway, while the side wall of the recess forms the outer wall of the passageway. The discharge or dispensing tube projects into the passageway and includes above its discharge orifice a vertically movable, spherical protective means which is intended to prevent the formation of bridges or ball-clusters in front of said orifice. It is obvious that this apparatus is susceptible to dirt particles wedging the ejector wheel against the wall of the recess, and it is doubtful that the proposed method is effective in preventing bridge formations. Another reason which speaks against satisfactory operation of this apparatus is that it would not appear to have had any success commercially.

Swedish Published Specification 455 901 teaches an automatic ball dispenser which is able to clean the golf balls to some extent at the same time. This apparatus includes a ball magazine whose bottom is comprised of a plurality of mutually parallel inclined devices which form tracks that lead to a pivotal ball dispensing arrangement. The lower ends of the tracks are covered by an inclined off-loading floor and beneath the roof or overhead covering there is provided a roll which includes means which as the roll rotates in a direction towards the direction in which the golf balls roll permits passage of the golf balls along one part of its periphery and counteracts passage of golf balls along another part of its periphery, and presses the golf balls back in a direction upwardly towards the magazine floor. The dispensing arrangement is comprised of a number of rods which extend in the extension of the bottom rods and are attached to an angle iron which defines a space corresponding to a golf ball. When emptying the dispenser, the dispensing arrangement is swung downwards and a curved barrier blocks the ball tracks temporarily. Similar apparatus are described and illustrated in WO 88/02270 and EP 0 328 855, in which the roll is comprised of a brush cylinder from which a chord section has been cut-out to allow passage of the golf balls. When balls are dispensed, the roll moves through one revolution and allows balls to pass when the chord section is located in its bottom position. The ball tracks or paths of these apparatus are covered by bars or the like proximal to the dispensing arrangement, so that balls will not be thrown up thereby. On the other hand, the tracks are open upwardly at a position adjacent the roll.

These apparatus have several deficiencies. The cleaning efficiency of the brush is much too low with only one brush revolution for each emptying cycle, particularly when no washing liquid is used. The balls are also able to pass down along a path which is distanced from the brush roll or cylinder and then roll freely out beneath the roll. These balls are completely untouched by the brush roll. Furthermore, stones and damaged balls are liable to remain in the ball tracks and prevent subsequent balls from rolling forwards. Half-balls may remain centrally beneath the brush roll and not be influenced thereby. Balls which have not rolled completely into their respective compartments, because these balls are damaged or are coated with dirt, are liable to be clipped or cut to pieces or firmly clamped during an emptying operation, resulting in a breakdown in operation.

SUMMARY OF THE INVENTION

The object of the present invention is therefore to provide a method and an arrangement which will enable golf balls to be cleaned effectively in a ball dispenser in conjunction with dispensing of the balls, which will ensure that damaged balls and stones will not block the discharge of following balls, and with which dispensing of the balls will be effected positively without the risk of damage to the balls or the balls being clamped in the dispenser, and which arrangement will be highly reliable in operation, require only small maintenance and will incur low operating costs.

This object is achieved with an inventive method wherein balls are brushed clean vigorously and for a long period, while all balls, even damaged balls, are brought forcibly to the ball dispensing arrangement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described in more detail with reference to an exemplifying embodiment thereof and also with reference to the accompanying, schematic drawings, in which.

DETAILED DESCRIPTION OF THE PREFERRED EMBODIMENT

Figure 1:
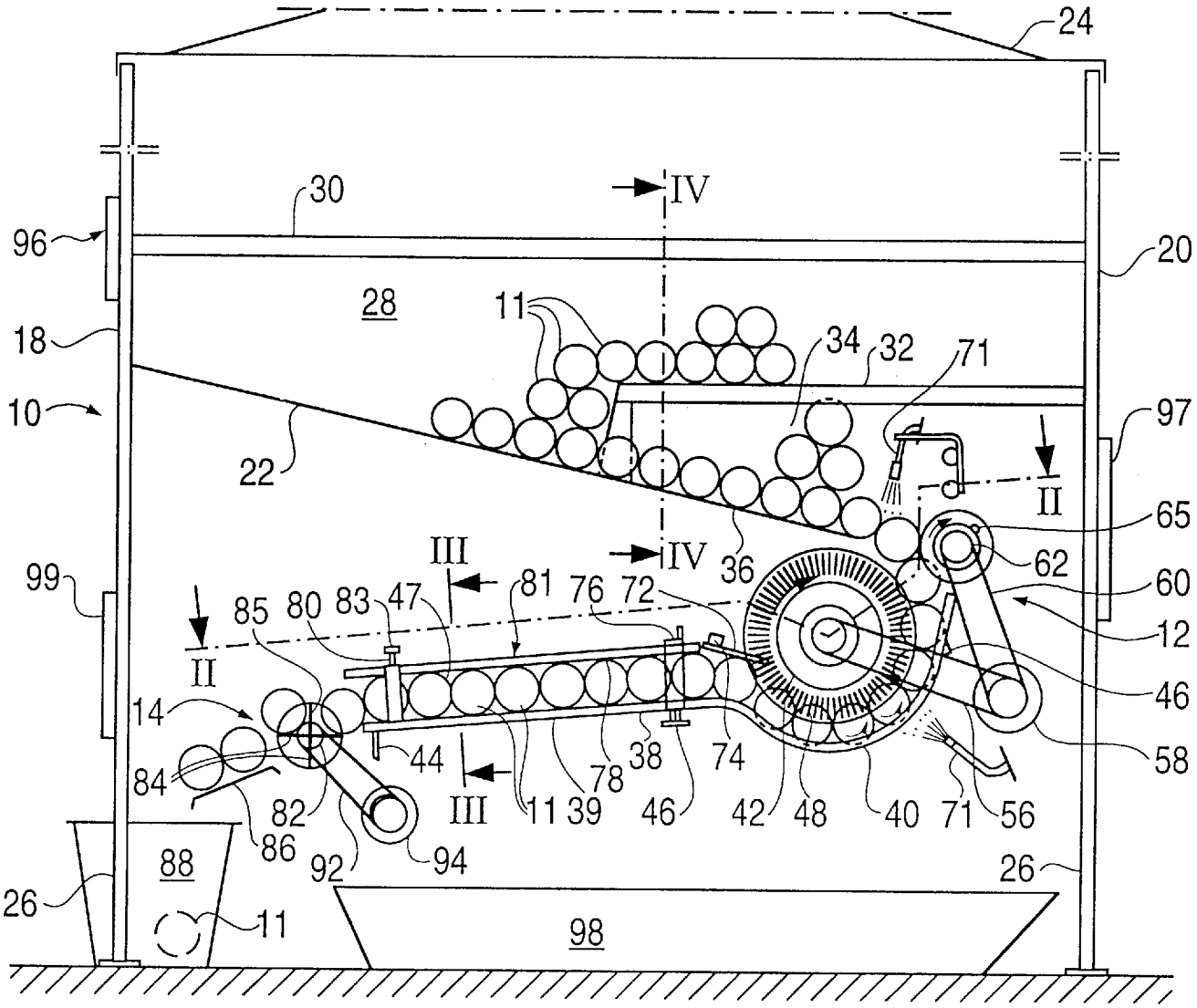
FIG. 1 is a longitudinal sectional view of an inventive arrangement.
Figure 2:
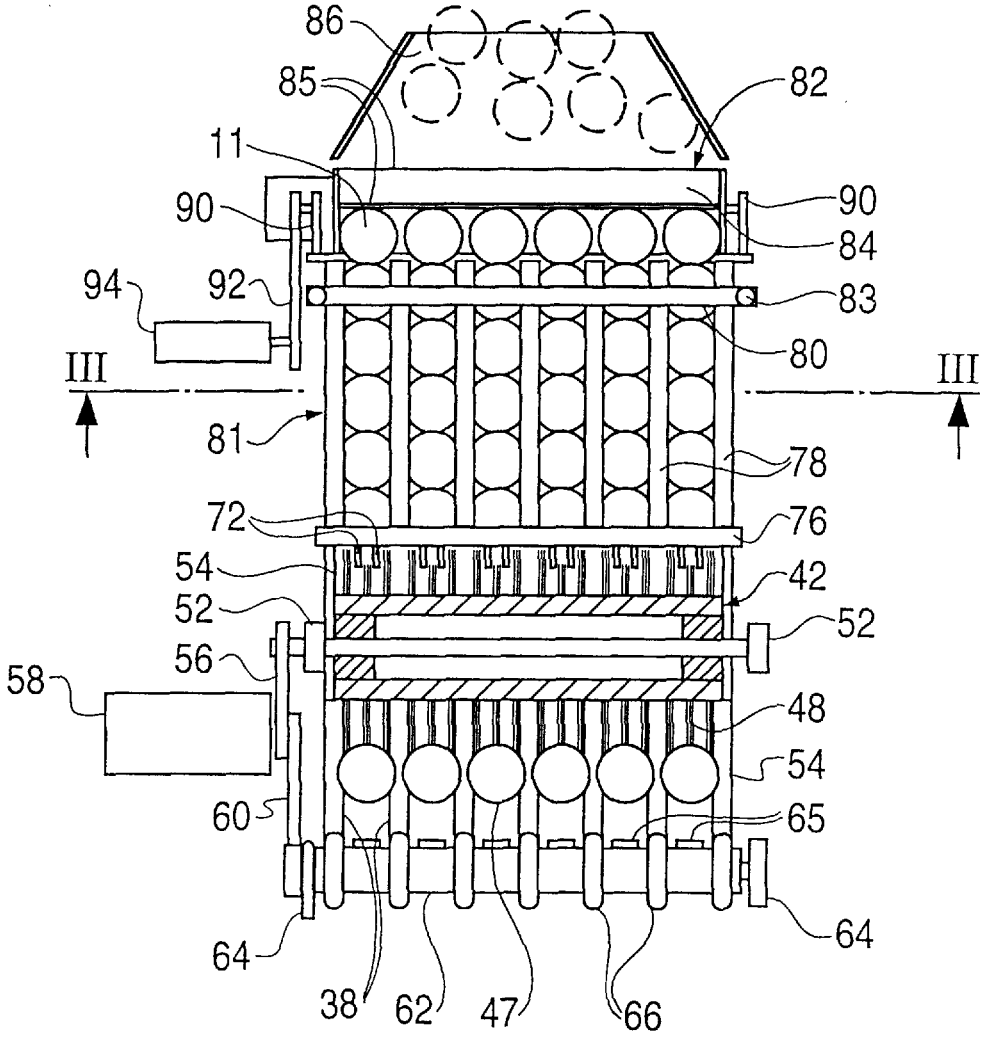
FIG. 2 is a top section taken on the line II—II in FIG. 1.

The inventive arrangement includes a housing 10, whose upper part also forms a ball magazine, a ball advancing and cleaning device 12, and a ball dispensing arrangement 14. The housing is comprised of two side walls 16, a front wall 18, a rear wall 20, a bottom 22 and an upwardly pivotal or removable lid 24. The housing rests on legs 26, although the walls may also extend down to the ground. The walls and bottom of the housing define a ball magazine 28. The housing also includes off-loading plates 30, 32 which function to protect the bottom of the magazine from large ball loads, and a chute opening 34 which leads to the ball advancing device 12.

The bottom of the chute opening 34 forms an infeed surface 36 of the ball advancing and cleaning device 12. This device includes a floor which comprises mutually parallel rod-like devices 38 whose upper ends 40 are curved and surround from between 25% and 50% of the periphery of a brush roll or cylinder 42. The ends 40 are at least generally arranged in a plane perpendicular to the axis of rotation of the roll. The remaining part 39 of the rod-like devices 38 slope straight down towards the ball dispensing arrangement 14. The rod-like devices 38 are attached to transverse braces or struts 44, 46, such that two mutually adjacent rods 38 will form a track 47 along which a ball is able to roll out of contact with balls on adjacent tracks. The brush roll 42 includes rings of bristles 48 which are disposed at a given axial spacing 50 along the length of the roll. The length of the bristles is such that as the roll rotates, the bristles will stroke the surface of the balls with only a small curvature so as to achieve an optimal clean-brushing effect. Accordingly, the rings of bristles located opposite the centre of the ball tracks 47 are shorter than the bristles in the rings located at the outer parts of the tracks. The brush roll 42 is journalled in bearings 52 on the side walls 54 of the ball dispensing arrangement and is driven by means of a chain or belt drive 56 which, in turn, is driven by a motor 58. The same motor also drives a roll 62 which is journalled eccentrically in a journal or bearing 64, through the medium of a further chain or belt drive 60. The roll 62 has extending along its length circumferentially extending ridges 66 which coincide with the rods 38 and which function to bring balls that enter along the tracks formed by the rods 38 into an ordered state. The rods 38 terminate immediately beneath the roll 62. Because the roll 62 is journalled eccentrically, it will periodically press back the balls 11 on the infeed surface 36 as the roll rotates and therewith stir or agitate and sort the balls in the tracks 47 formed by the rods 38. This stirring or agitation of the balls will also break-up any ball-clusters that hang-up and form bridges on the infeed plane 36.

The curved parts 40 of the rods 38 which partially embrace the brush roll are each provided with a particular high friction coating 68 or a profiled surface. The reason for this is because the golf balls shall not only be pushed forwards by the brush roll but shall also roll around on the rods 38 and therewith be brushed clean from grit and dirt on all sides of the balls. The provision of parts 69 which are free from friction-enhancing means patch-wise on one of a pair of rods, will also allow balls to slide on this part of the rod and therewith perform a pivotal or twisting movement in addition to a rolling movement. This improves cleaning of the balls by the brush arrangement. Cleaning of the golf balls can be further improved by providing spray nozzles 71 through which water or some other cleaning liquid can be sprayed, for instance on the infeed side of the brush roll, along the conveying path of the roll and/or on its outfeed side.

Guide rails 72 which extend into the space 50 between the rings of bristles 48 are arranged on the outfeed side of the brush roll 42. The guide rails are mounted on a cross-brace 74. Alternatively, the rails may be mounted on a cross-shaft 76 which supports rods 78 located above each of the rod-like devices 38 and upwardly define the ball tracks 47. The outer ends of the rods 78 are connected to a cross-bar 80. The rods 78 and the cross-bar 80 together form a raisable grid structure 81 which, when raised, enables stones, damaged balls and other obstacles in the ball track to be removed therefrom. When lowered and locked in position with the aid of a locking device 83, the rods 78 and the rod-like devices 38 define tracks or paths 47 which are closed on all sides. While balls 11 roll along these tracks, whereas balls from which pieces are missing, and stones, which in earlier known ball dispensers would remain and prevent balls from being advanced are in this case forced over the rod-like devices 38 by means of the brush roll and also by the subsequently advanced balls. The straight part of the rod-like devices 38 will conveniently generate less friction than the curved part 40, although not necessarily extremely low friction, and conveniently comprise bright metal. It is essential that the ball tracks 47 are completely covered downstream of the brush roll, since this would otherwise press the balls straight through and pile them up. Such a quick through-feed of the balls with the balls rolling against both the curved track parts and the brush would result in poor ball washing.

The ball dispensing arrangement 14 includes a pivotal part 82 which has at least one compartment 84 for accommodating at least one ball 11 for each of the ball tracks 47. In the case of the illustrated embodiment, this pivotal part is comprised of an outfeed roller of a cell feeder type. The outfeed roll has a lifting device 85 which lifts the balls to an outfeed chute 86 and further to a ball bucket 88. Lifting of the balls avoids balls that have only been inserted partially into the compartment being clipped or cut to pieces. Instead, the grid 81 is lifted or springs slightly upwards and then falls down again. The outfeed roll is journalled on both sides in bearings 90 and can be rotated about its longitudinal axis by means of a chain or belt drive 92 driven by a further motor 94. Alternatively, a pivotal cradle can be used for one or more rows of balls, instead of the outfeed roll.

The arrangement is controlled operationally by an operations centre 96, which is illustrated symbolically in the drawing and which includes a coin or token insertion slot, or alternatively a slot into which a pay card can be inserted. The operations centre 96 includes electronic circuits for controlling the motors 58 and 94, and relay valves for delivering liquid to the spray nozzles 71. When payment has been made, the liquid dispensing valves are open and the brush roll 42 and the eccentric roll 62 begin to rotate, wherein the brush roll rotates at a higher speed than the speed at which the balls are dispensed by the ball dispensing arrangement. Balls are advanced, washed, and brushed clean and the track spaces 47 are filled with balls, if this has not already been done.

At the same time, the outfeed roll 82 is rotated through a number of ball feeding increments corresponding to the number of balls for which payment has been made, and the balls are dispensed into the bucket 88. Washing liquid and solid dirt particles are collected in a tray 98 beneath the apparatus, or are allowed to run out through an outlet provided to this end.

The outfeed roll 82 is driven at a speed of 15 r.p.m., whereas the brush roll 48 is rotated at 32 r.p.m. The tips of the bristles thus move more rapidly than the balls, so as to provide an intensive brushing action. Movement of the balls is braked further each time one of the lifters 85 on the outfeed roll 82 is brought to a position in front of the ball tracks, and the ball surfaces that face towards the brush roll 42 are worked particularly intensively by the bristles. The balls are braked several times during their passage past the brush roll and fresh surfaces are caused to pass slowly beneath the brush, or bristles, each time movement of the balls is retarded.

To prevent damaged balls and stones from being discharged from the apparatus, the inventive arrangement is provided with flaps 97, 99 which facilitate cleaning and servicing of the arrangement. The flap 97 located on the rear of the apparatus provides access to the inlet side of the roll, while the flap 99 located on the outlet side of the apparatus enables the grid 81 to be lifted and stones and half-balls to be removed from the apparatus.

Figure 3:
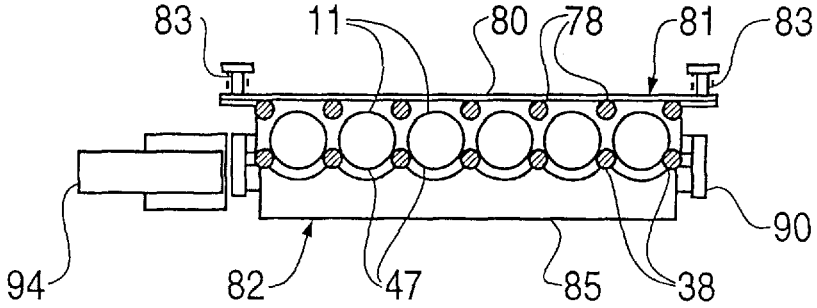
FIG. 3 is a cross-section taken on the line III—III in FIG. 2.
Figure 4:
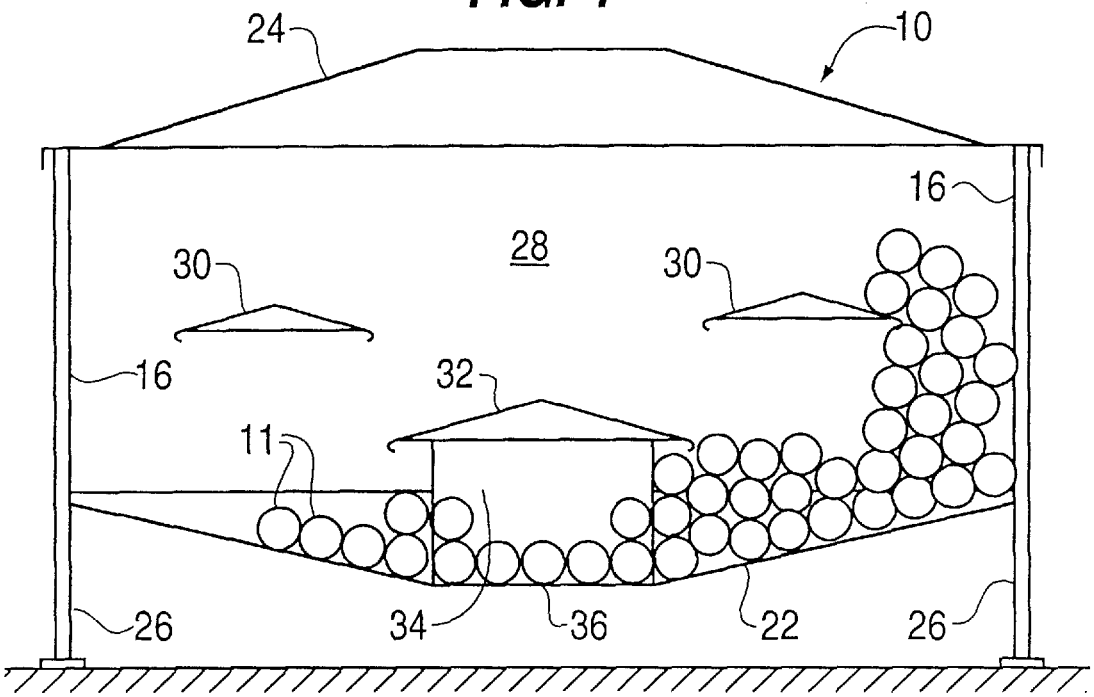
FIG. 4 is a sectional view of the ball magazine of the arrangement.
Figure 5:
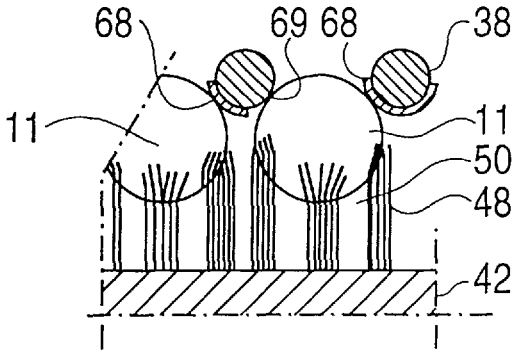
FIG. 5 is a sectional view of part of a ball track or path.

It will be understood that the invention is not restricted to the illustrated and described exemplifying embodiments thereof and that modifications can be made within the scope of the inventive concept as defined by the following claims. The rod-like devices 38 may have the form of round rods or tubes made of metal or wear-durable plastic, although they may also have other cross-sectional shapes or different extensions in the vertical direction. The roll 62 may also be centrical and present radially extending raised parts 65 along a part of its periphery, to achieve stirring and agitation of the balls. The motor 94 may also be a direct-drive motor in the absence of a chain, as illustrated in FIG. 3.

I claim:

1. A method for cleaning and dispensing spherical objects from a magazine, wherein the objects are brushed clean by a brush roll and are passed over a plurality of mutually parallel devices which define at least one track leading to a dispensing arrangement, said method comprising the steps of:

causing the objects to pass around a curved track by means of a brush roll which rotates in the direction of movement of the objects toward the dispensing arrangement, said curved track defined by curved upper ends of the mutually parallel devices which surround a portion of the brush roll and follow an outer curvature of the brush roll through a distance which is shorter than one complete revolution around the brush roll, and in a plane which extends generally perpendicular to the rotational axis of the brush roll;

causing the objects to move along the at least one track at a speed which is slower than the peripheral speed of the brush roll; and forcing the objects to move along the remainder of said at least one track and to the dispensing arrangement through which the objects are dispensed.

2. The method according to claim 1, wherein the objects are caused to rotate during their passage past the brush roll by rolling against said curved upper ends, which on those parts that lie proximal to the brush roll at least partially are provided with a high friction coating such that all sides of the objects are brought in contact with the brush roll.

3. The method according to claim 1, further comprising the step of treating the objects with a washing liquid.

4. The method according to claim 1, wherein the distance is approximately one half of the circumference of the brush roll.

5. A method for cleaning and dispensing spherical objects from a magazine, wherein the objects are brushed clean by a brush roll and are passed over a plurality of mutually parallel devices which define at least one track leading to a dispensing arrangement, said method comprising the steps of:

causing the objects to pass around a curved track by means of a brush roll which rotates in the direction of movement of the objects toward the dispensing arrangement, said curved track defined by curved upper ends of the mutually parallel devices which surround a portion of the brush roll and follow an outer curvature of the brush roll through a distance which is shorter than one complete revolution around the brush roll, and in a plane which extends generally perpendicular to the rotational axis of the brush roll;

causing the objects to move along the at least one track at a speed which is slower than the peripheral speed of the brush roll;

forcing the objects to move along the remainder of said at least one track and to the dispensing arrangement through which the objects are dispensed;

providing an eccentrically journalled transversely extending roll having radial projections thereon and located above and on the side of said at least one track distal from the brush roll; and causing the transversely extending roll to rotate against the direction of movement of the objects and thereby force said objects in a rearward direction intermittently, so as to break-up any bridges or clusters that the objects form and such as to sort the objects into the at least one track.

6. The method according to claim 5, wherein the objects are caused to rotate during their passage past the brush roll by rolling against said curved upper ends, which on those parts that lie proximal to the brush roll at least partially are provided with a high friction coating such that all sides of the objects are brought in contact with the brush roll.

7. The method according to claim 5, further comprising the step of treating the objects with a washing liquid.

8. The method according to claim 5, wherein the distance is approximately one half of the circumference of the brush roll.

9. Apparatus for cleaning and dispensing substantially spherical objects, said apparatus comprising:

a magazine for collecting said objects therein;

a plurality of mutually parallel devices mounted beneath the magazine and which define at least one track which leads to a dispensing arrangement; and a transversely extending brush roll rotatable in the direction of movement of the objects along the track toward the dispensing arrangement, wherein the parallel devices have curved upper ends surrounding a portion of the underside of the brush roll and following an outer curvature of the brush roll around a distance which is shorter than one complete revolution around the brush roll, said curved upper ends being positioned at a distance from the brush roll which is shorter than the diameter of the objects, said curved upper ends being disposed at least essentially in a plane which is normal to the rotational axis of the brush roll, wherein said at least one track between the brush roll and the dispensing arrangement is delimited upwards by a covering which holds the objects down in the track, and wherein the brush roll rotates at a higher peripheral speed than the speed at which the objects are moved along the track toward the dispensing arrangement.

10. The apparatus according to claim 9, wherein the curved upper ends of the parallel devices surrounding the underside of the brush roll are provided on those parts that lie proximal to the roll at least partially with surfaces which will generate more friction than the straight parts of said parallel devices.

11. The apparatus according to claim 9, further comprising a transversal roll journalled eccentrically above said at least one track and on the side thereof opposite to the brush roll, said transversal roll being provided with radial projections and rotatable in a direction towards the direction of movement of the objects toward the dispensing arrangement.

12. The apparatus according to claim 9, wherein the dispensing arrangement includes a pivotal part having at least one compartment for at least one object for each of the tracks, wherein the pivotal part lifts the objects up to an outfeed chute.

13. The apparatus according to claim 9, wherein the dispensing arrangement includes drive means which is separate from the brush roll.

14. The apparatus according to claim 9, wherein the covering is movable in response to the presence of misfed objects and foreign objects dogged or entrained by the dispensing arrangement.

15. The apparatus according to claim 9, further comprising means for delivering washing liquid to the region proximate to the brush roll.

16. The apparatus according to claim 9, wherein said distance is approximately one half of the circumference of the brush roll.

* * * * *